US011466515B2

(12) United States Patent
Fang

(10) Patent No.: US 11,466,515 B2
(45) Date of Patent: Oct. 11, 2022

(54) LIFTING PUSH-PULL POSITIONING CURTAIN

(71) Applicants: Lewis Hyman Inc., Carson, CA (US); Florid Bamboo Ltd. Co., Anji (CN)

(72) Inventor: Xiaoliang Fang, Anji (CN)

(73) Assignees: Lewis Hyman Inc., Carson, CA (US); Florid Bamboo Ltd. Co., Anji (CN)

( * ) Notice: Subject to any disclaimer, the term of this patent is extended or adjusted under 35 U.S.C. 154(b) by 242 days.

(21) Appl. No.: 16/059,268

(22) Filed: Aug. 9, 2018

(65) Prior Publication Data

US 2019/0085629 A1 Mar. 21, 2019

(30) Foreign Application Priority Data

Aug. 10, 2017 (CN) ..... 201721045481.3
Jul. 16, 2018 (CN) ..... 201821123216.7
Jul. 16, 2018 (CN) ..... 201821123903.9

(51) Int. Cl.

| | |
|---|---|
| ***E06B 9/68*** | (2006.01) |
| ***E06B 9/78*** | (2006.01) |
| ***E06B 9/42*** | (2006.01) |
| ***E06B 9/262*** | (2006.01) |
| ***E06B 9/322*** | (2006.01) |

(52) U.S. Cl.

CPC ..... *E06B 9/68* (2013.01); *E06B 9/262* (2013.01); *E06B 9/322* (2013.01); *E06B 9/42* (2013.01); *E06B 9/78* (2013.01); *E06B 2009/2622* (2013.01); *E06B 2009/3222* (2013.01)

(58) Field of Classification Search

CPC . E06B 9/68; E06B 9/262; E06B 9/322; E06B 9/78; E06B 9/42; E06B 2009/2622; E06B 2009/3222

See application file for complete search history.

(56) References Cited

U.S. PATENT DOCUMENTS

| | | | | |
|---|---|---|---|---|
| 6,289,965 | B1 * | 9/2001 | Ruggles | E06B 9/322 160/170 |
| 6,761,203 | B1 * | 7/2004 | Huang | E06B 9/322 160/170 |
| 7,311,134 | B2 * | 12/2007 | Cheng | E06B 9/322 160/170 |
| 9,435,154 | B2 * | 9/2016 | Chen | E06B 9/262 |
| 9,482,049 | B2 * | 11/2016 | Chen | E06B 9/322 |
| 9,587,428 | B2 * | 3/2017 | Huang | E06B 9/323 |
| 9,845,639 | B2 * | 12/2017 | Chen | E06B 9/322 |

(Continued)

*Primary Examiner* — Johnnie A. Shablack

(74) *Attorney, Agent, or Firm* — NZ Carr Law Office

(57) ABSTRACT

The object of the present invention is to provide a lifting type push-pull positioning curtain which can realize the self-locked positioning of the curtain body without the exposed drawstring and can adjust the unfolding length of the curtain body infinitely. A lifting type push-pull positioning curtain, comprises a curtain body, a mounting box and a push-pull positioning device. The push-pull positioning device comprises an active reel, a transmission wheel set and a slave reel. The transmission wheel set comprises a driving wheel and a driven wheel, the driven wheel receive a scroll spring therein, the head end of the scroll spring is connected to the driving wheel; the active reel and the slave reel are wound with a thread rope therein respectively, and one end of the thread rope is fixed to the reel and the other end thereof is fixed to the bottom of the curtain.

12 Claims, 7 Drawing Sheets

(56) References Cited

U.S. PATENT DOCUMENTS

| | | | | |
|---|---|---|---|---|
| 10,000,967 | B2 * | 6/2018 | Huang | E06B 9/322 |
| 10,273,748 | B2 * | 4/2019 | Chen | E06B 9/322 |
| 10,480,244 | B2 * | 11/2019 | Chen | E06B 9/78 |
| 2006/0096719 | A1 * | 5/2006 | Wu | E06B 9/32 160/170 |
| 2007/0227677 | A1 * | 10/2007 | Yu | E06B 9/322 160/170 |
| 2013/0112353 | A1 * | 5/2013 | Sengelaub | E06B 9/262 160/84.02 |
| 2014/0083631 | A1 * | 3/2014 | Huang | E06B 9/80 160/170 |
| 2014/0291431 | A1 * | 10/2014 | Huang | E06B 9/322 242/372 |
| 2015/0136336 | A1 * | 5/2015 | Huang | E06B 9/322 160/170 |
| 2016/0280506 | A1 * | 9/2016 | Huang | E06B 9/60 |
| 2016/0298385 | A1 * | 10/2016 | Chen | E06B 9/324 |
| 2016/0340975 | A1 * | 11/2016 | Huang | E06B 9/322 |
| 2017/0298688 | A1 * | 10/2017 | Chen | F03G 1/00 |
| 2017/0356241 | A1 * | 12/2017 | Lin | E06B 9/32 |
| 2018/0230739 | A1 * | 8/2018 | Huang | E06B 9/262 |
| 2018/0230741 | A1 * | 8/2018 | Zheng | E06B 9/322 |
| 2018/0230744 | A1 * | 8/2018 | Huang | E06B 9/322 |
| 2018/0291678 | A1 * | 10/2018 | Zheng | E06B 9/322 |
| 2018/0291679 | A1 * | 10/2018 | Zheng | E06B 9/323 |
| 2018/0363369 | A1 * | 12/2018 | Chen | E06B 9/322 |
| 2019/0162016 | A1 * | 5/2019 | Chen | B65H 75/34 |
| 2019/0162018 | A1 * | 5/2019 | Chen | E06B 9/322 |
| 2020/0157879 | A1 * | 5/2020 | Lei | E06B 9/305 |
| 2020/0180902 | A1 * | 6/2020 | Zheng | B65H 75/486 |

* cited by examiner

LIFTING PUSH-PULL POSITIONING CURTAIN

RELATED APPLICATIONS

This application claims the benefit of Chinese Application Serial No. 201821123903.9, filed Jul. 16, 2018; Chinese Application Serial No. 201821123216.7, filed Jul. 16, 2018; Chinese Application Serial No. 201821123226.0, filed Jul. 16, 2018; Chinese Application Serial No. 201721045481.3, filed Aug. 10, 2017; all of which are incorporated herein by reference in their entirety.

TECHNICAL FIELD

The present invention relates to a roller shade, and more particularly to a push-pull positioning curtain that can stay at any position.

BACKGROUND TECHNIQUE

A roller shade is a curtain of which a curtain cloth is processed by resin or that is formed by weaving a bamboo strip or a reed rod and can be rolled into a roll. The roller shade is lifted and lowered with a drawstring or a chain. For the common roller shade, the curtain is winded up and retracted by pulling the drawstring connected to the lower end thereof, and the curtain is automatically hung down by loosening a pull wire, a push-pull rope is locked or loosened by a retracting mechanism fixed to an upper rail. When such curtain is put away, the overhanging end of the drawstring shall be pulled, so that the other end of the drawstring can lift the drooping end of the roller shade, and the roller shade is wound up. It is more laborious to push and pull the pull rope to control the roller shade in this way, and the drawn drawstring is exposed and hung outside, which is too cumbersome and cannot be stored, and the exposed drawstring is often entangled with other objects, and the exposed drawstring that falls on the ground is likely to trip or even twist the child, posing a safety hazard.

SUMMARY OF THE INVENTION

The object of the present invention is to provide a lifting push-pull positioning curtain which can realize the self-locked positioning of the curtain body without the exposed drawstring and can adjust the unfolding length of the curtain body infinitely.

A lifting push-pull positioning curtain comprises a curtain body, a mounting box and a push-pull positioning device.

Push-Pull Positioning Device

As a preferred solution, the push-pull positioning device is located in the mounting box, the mounting box comprises an upper mounting plate and a lower mounting plate; the push-pull positioning device comprises an active reel, a transmission wheel set and a slave reel, the lower mounting plate is provided thereon with a positioning post, the active reel, the transmission wheel set and the slave reel correspond to respective positioning posts respectively;

The transmission wheel set comprises a driving wheel and a driven wheel, the driven wheel receive a scroll spring therein; the head end of the scroll spring is connected to the driving wheel, the active reel and the slave reel are wound with a thread rope therein respectively, one end of the thread rope is fixed to the reel and the other end thereof is fixed to the bottom of the curtain; when the active reel is outwardly unwound, the driving wheel winds the scroll spring inwardly; the direction of the scroll spring being wound into the driving wheel is opposite to the direction of a scroll. The direction of the scroll refers to the direction in which the scroll spring is wound by means of a conventional process. When the surface of the scroll spring in contact with the driven wheel is an inner surface, the surface of the scroll spring in contact with the driving wheel is an outer surface.

The length of the thread ropes corresponding to the active reel and the slave reel is the same, and the length of the thread rope received in the reels is also the same. Thereby, the bottom of the curtain body is kept horizontal, and is horizontally raised and lowered.

As a preferred solution, the active reel, the slave reel, the driving wheel and the driven wheel have respective gears, winding posts and retainer rings respectively, and the gear and the retainer ring are located at two ends of the winding post respectively, four gears are sequentially engaged, a distance is provided between the four retainer rings. Thus, for each wheel, the reel or the transmission wheel, only one end thereof is processed into the gear, which not only reduces the processing difficulty, but also indicates the mounting direction of a wheel.

As a preferred solution, the active reel, the driving wheel, the driven wheel and the slave reel are sequentially engaged, and the scroll spring in a natural state is located in the driven wheel, the direction of rolling the scroll spring by the driving wheel is the same as the direction of rolling the thread rope by the active reel; the direction of rolling the thread rope by the active reel is the same as the direction of rolling the thread rope by the driven wheel. When the gears are meshed in transmission, the adjacent gears rotate in opposite directions. When the active reel is outwardly unwound, the scroll spring is reversely wound by the driving wheel, and the scroll spring in the driving wheel is in a deformed state, the gravity of the curtain body is balanced with the elastic force of the scroll spring. As a preferred solution, the length of the scroll spring is greater than the length of the thread rope wound around the reel. Thus, after the thread rope is completely released, the scroll spring still has a residual length in the driven wheel. Therefore, there is no need to perform a fixing process between the trailing end of the scroll spring and the driven wheel, and the scroll spring can be held in the driven wheel by the elastic force of the scroll spring itself.

Driving Wheel and Driven Wheel

As a preferred solution, the winding post of the driving wheel is thicker than the winding post of the driven wheel. The thicker the winding post of the driving wheel, the larger the radius of curvature of the scroll spring. Therefore, when the scroll spring is wound into the driving wheel, as the scroll spring is wound into the driving wheel, the radius of curvature of the deformation of the spring in the driving wheel is larger than the radius of curvature of the spring in the driven wheel, that is, the more the scroll spring is wound into the driving wheel, the tendency of the spring to recover deformation is weaker, avoiding the problem that the curtain body automatically rises due to excessive spring force of the spring tail.

As a preferred solution, after the scroll spring is mounted in position in the driven wheel, the diameter of the winding post of the driven wheel superimposed with the scroll spring is equal to the diameter of the winding post of the driving wheel. The equality of two diameters means that the difference between the two diameters is within the allowable error range and is not absolutely equal in mathematical terms. In this way, when the scroll spring is just wound into the driving wheel, the winding radius of curvature of the scroll spring in the driving wheel is substantially equal to the winding radius of curvature of the scroll spring in the driven wheel, after all the wires in the reel are released, the diameter of the spring in the drive wheel is maximized while the diameter of the spring in the driven wheel is minimized.

As a preferred solution, the head end of the scroll spring is provided with a hook, the winding post of the driving wheel is provided with a socket, the hook is hung in the socket. As a preferred solution, the winding post of the driving wheel comprises a positioning sleeve barrel and a winding sleeve barrel, the positioning sleeve barrel and the winding sleeve barrel are coaxial and spaced apart, a radial connecting rib plate is provided between the positioning sleeve barrel and the winding sleeve barrel, the socket penetrates the winding sleeve barrel. The hook is inserted into the socket, and the winding sleeve is hooked to realize the connection between the scroll spring and the driving wheel. As a preferred solution, the two ends of the socket are radial slopes. The slope guides the scroll spring so that the spring is smoothly rolled into the winding post. The diameter of the winding sleeve is the diameter of the winding post of the driving wheel. As a preferred solution, the driven wheel comprises a gear assembly and a retainer ring assembly, the gear assembly consists of the gear and a positioning sleeve, the gear and the positioning sleeve are concentric and fixed; the retainer ring assembly consists of an inner sleeve barrel, an outer sleeve barrel and a retainer ring that are coaxial, a space is provided between the inner sleeve barrel and the outer sleeve barrel, a radial connecting plate is arranged between the inner sleeve barrel and the outer sleeve barrel, the positioning sleeve is inserted into the inner sleeve barrel and is in clearance fit with the inner sleeve barrel; the diameter of the outer sleeve barrel is taken as the diameter of the winding post of the driven wheel. The gear assembly and the retainer ring assembly are detachable so that a scroll spring product can be conveniently sleeved on the outer sleeve barrel, and the positioning sleeve is inserted into the inner sleeve barrel, the gear assembly and the retainer ring assembly are combined into the driven wheel with the scroll spring. The driven wheel is detachable, which makes it easy to use the finished scroll spring to reduce costs.

As a preferred solution, the scroll spring comprises a spring band with an constant width, the head end of the spring band is provided with a hook, the hook is T-shaped, the spring band is rolled into a cylinder by means of a conventional process, and the radius of machined curvature of the spring band is featured by a big outer ring and a small inner ring. That is to say, when the scroll spring is machined, the machined radius of curvature gradually increases from the head end to a tail end, and when the scroll spring is naturally wound, the inner ring of the scroll spring has a machined curvature greater than that of the outer ring thereof. Therefore, when the scroll spring is reversely wound into the driving wheel, the restoring force of the scroll spring in the driving wheel is gradually reduced from the inside to the outside, so as to conform to the gradual unfolding of the curtain body and the force reinforced on the thread rope is gradually reduced.

The Upper Mounting Plate and the Lower Mounting Plate

As a preferred solution, the upper mounting plate and the lower plate form a mounting box for receiving the active reel, the transmission wheel set and the slave reel; the mounting box has a wire outlet port for allowing the thread rope out; the upper mounting plate has a screw through hole corresponding to the positioning post of the lower mounting plate one by one, the positioning post is provided thereon with a screw hole aligned with the screw through hole. After the screw is screwed into the screw hole by passing through the screw through hole, the upper mounting plate is fixed at the lower mounting plate. The upper mounting plate and the lower mounting plate limit the axial position of the two reels and the transmission wheel set so that the four gears remain engaged.

As a preferred solution, the lower mounting plate is provided with a lower plate limiting groove, the lower plate limiting groove has a lower plate arc portion corresponding to each gear one by one, each lower plate arc portion is in clearance fit with the corresponding gear. The lower plate limiting groove matches the gear, and the size of the lower plate limiting groove is larger than that of the retainer ring. The lower plate limiting groove has a function of indicating, which indicates that the gear should be provided with the lower mounting plate. As a preferred solution, the lower plate limiting groove is centered with the lower mounting plate, and each lower plate arc portion of the lower plate limiting groove is coaxial with the corresponding positioning post. After determining the gear diameter and the gap between the gear and the lower plate limiting groove, the position and size of the lower plate limiting groove can be determined; and then the positioning posts with concentricity is provided at the center of a circle of each lower plate arc portion of the lower plate limiting groove to determine the position of the positioning post. Each positioning post, the wheel and the corresponding lower plate arc portion are coaxial.

As a preferred solution, the lower mounting plate comprises a bottom plate and two opposite side plates, and the lower plate limiting groove is provided on the bottom plate, and the upper mounting plate is opposite to the bottom plate. The upper mounting plate and the lower mounting plate form a rectangular box body, and there are no closed openings at both ends as wire outlet ports.

As a preferred solution, a positioning hole group is provided around each positioning post, the positioning hole group is provided on the bottom plate, each positioning hole group forms an equilateral polygon, and the positioning post and the equilateral polygon formed by the positioning hole group are concentric. The positioning post and the lower mounting plate are integrally injection-molded, each positioning hole group can be used as a release hole while injection molding, so that each positioning post can be demolded in translation, and the verticality of the positioning post and the bottom plate can be ensured. As a preferred solution, each positioning hole group has four positioning holes, wherein a pair of diagonal positioning holes are collinear with all the positioning posts. The four positioning holes make the circumference of the positioning post evenly stressed, which is beneficial to ensure the verticality. The more the positioning post is perpendicular to the bottom plate, the smaller the impact between a wiring wheel and the positioning post, as well as the impact between the driving wheel and the positioning post and the impact between the driven wheel and the positioning post.

As a preferred solution, the upper mounting plate is provided with an upper plate limiting groove, the upper plate limiting groove has an upper plate arc portion corresponding to each of the retainer rings one by one, each upper plate arc portion is in clearance fit with a corresponding gear; the upper plate limiting groove is centered with an upper plate, each upper plate arc portion is coaxial with the corresponding screw through hole. After determining the diameter of the retainer ring and the gap between the retainer ring and the upper limiting groove, the position and size of the upper plate limiting groove can be determined; and then the concentric screw through hole is provided at the center of a circle of each upper plate arc portion in the upper plate limiting groove to determine the position of the screw through hole. Each of the screw through holes, the wheel and the corresponding upper plate arc portion are coaxial. After the screw through holes cooperate with the corresponding positioning post, the centering of the upper mounting plate and the lower mounting plate is achieved.

As a preferred solution, the upper mounting plate is provided with a cylindrical protrusion, each screw through hole corresponds to one protrusion, the screw through hole is coaxial with the respective protrusion; each protrusion is inserted into the corresponding positioning sleeve barrel or the positioning sleeve, the protrusion is in contact with or has a gap with the corresponding positioning post; or, the positioning post is provided with a groove for allowing the protrusion to be inserted, the height of the groove is adapted to the protrusion. The protrusion and the positioning post simultaneously position the axial position of the winding post while locking the relative position between the upper mounting plate and the lower mounting plate; in addition, the protrusion protects the screw, the active reel, the slave reel, the driving wheel and the driven wheel are not directly in contact with the screw, and the vibration produced when the active reel, the slave reel, the driving wheel and the driven wheel are rotated is isolated by the protrusion Wiring Post As a preferred solution, the lower mounting plate is provided with a pair of center wiring posts and at least one pair of side wiring posts; the two center wiring posts are collinear with the positioning post, the two side wiring posts deviate from the straight line where the positioning post is located; the two center wiring posts are symmetrically arranged, the two side wiring posts are symmetrically arranged; the thread rope is taken out from the wire outlet port by bypassing sequentially the side wiring post and the center wiring post. The side wiring post tensions the thread rope, the center wiring post makes the drawn thread rope collinear with the center of the two reels, which is favorable for the thread rope to smoothly output the wire.

As a preferred solution, two pairs of the side wiring posts are provided, the two pairs of the side wiring posts are symmetric with respect to the straight line where the positioning post is located. As a preferred solution, the thread rope is sequentially taken out from the wire outlet port by bypassing the two side wiring posts and the center wiring post; or the thread rope is taken out from the wire outlet port after bypassing any side wiring posts and the center wiring post; or, the thread rope is taken out from the wire output port after sequentially bypassing the two side wiring posts, the center wiring post tightly abuts the thread rope between the two side wiring posts. The two wiring posts facilitate the tensioning of the thread rope and eliminate the change in the direction of the thread rope caused by the change in the diameter of the rope during the winding and unwinding of the reel.

As a preferred solution, the center wiring post is provided with a screw hole, the upper mounting plate has the screw through hole aligned with the center wiring post, the screw is screwed into a screw hole of the center wiring post through the screw through hole. Therefore, the two sides of the upper mounting plate and the lower mounting plate are relatively fixed to avoid deformation and displacement of the center wiring post under the pressure of the thread rope, and the consistency of the two reels is maintained, so that the bottom of the curtain is always horizontal. As a preferred solution, the center wiring post is located outside the lower plate limiting groove, and a gap is provided between the center wiring post and the lower plate limiting groove.

As a preferred solution, the upper mounting plate has a circle ring matching the center wiring post, the center wiring post is inserted into the circle ring, the screw through hole is coaxial with the circle ring. The circle ring locks the position of the center wiring post to prevent the vibration from directly impacting the screw.

Active Reel and Slave Reel

As a preferred solution, the winding post of the active reel and the winding post of the slave reel are both conical, and one end of the winding post in contact with the gear is a big end and the other end thereof is a small end. When the curtain is moved up and the thread rope is recovered into the reel, the thread ropes of the two reels are displaced from the big end to the small end, so that the active reel and the slave reel are wound synchronously in the same length, and the bottom of the curtain is always kepthorizontal.

Wiring Wheel

As a preferred solution, the top of the curtain body is provided with a fixing plate, the bottom of the curtain body is provided with a weighting block; the push-pull positioning device is mounted on the fixing plate, the fixing plate is provided with a pair of the wiring wheels, the wiring wheel is symmetrically provided on both sides of the push-pull positioning device; the wiring wheel comprises a bracket and a pulley, the thread rope bypasses the pulley, the bracket has a shaft thereon, the pulley is rotatably connected with the shaft, the bracket is hinged with the fixed plate. The wiring wheel can swing with the thread rope to allow the wiring at any angle, so that the unwinding and winding of the active reel and the slave reel are not affected by the angle.

The present invention has the advantages that: 1. the thread rope is not exposed, so that the appearance of the curtain body is simple and the potential safety hazard is avoided. 2. The elastic force of the scroll spring is balanced with the gravity of the curtain body, so that the curtain body can stay at any desired position. 3. The diameter of the winding post of the driving wheel is larger than the diameter of the winding post of the driven wheel, as the scroll spring is screwed into the driving wheel, a restoring force of the scroll spring is gradually reduced, preventing the force of the tail of the scroll spring in the driven wheel from being excessive, which causes the curtain body automatically rise; and the scroll spring is re-entangled into the driving wheel, so that the scroll spring maintains the restoring force, preventing the curtain body from getting stuck while rising, and preventing the curtain body from dropping automatically.

Figure 1:
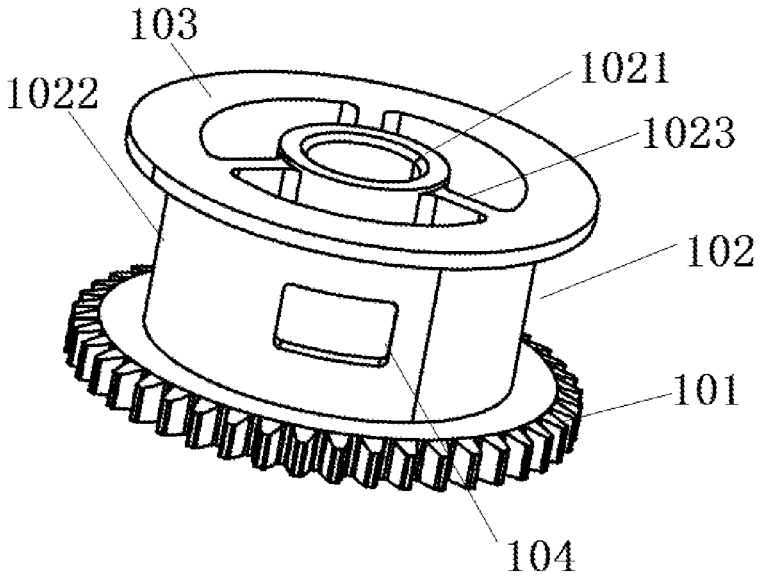
FIG. 1 is a perspective view of a driving wheel in one embodiment of the present invention.
Figure 2:
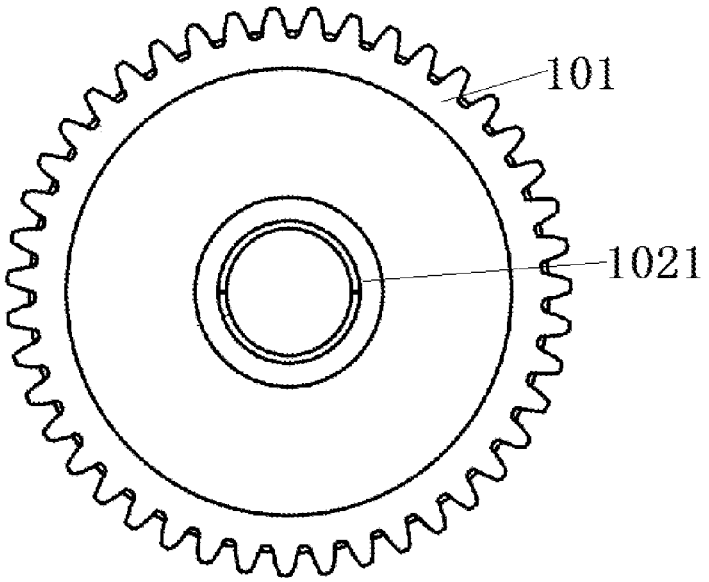
FIG. 2 is a bottom view of a driving wheel in one embodiment of the present invention.
Figure 3:
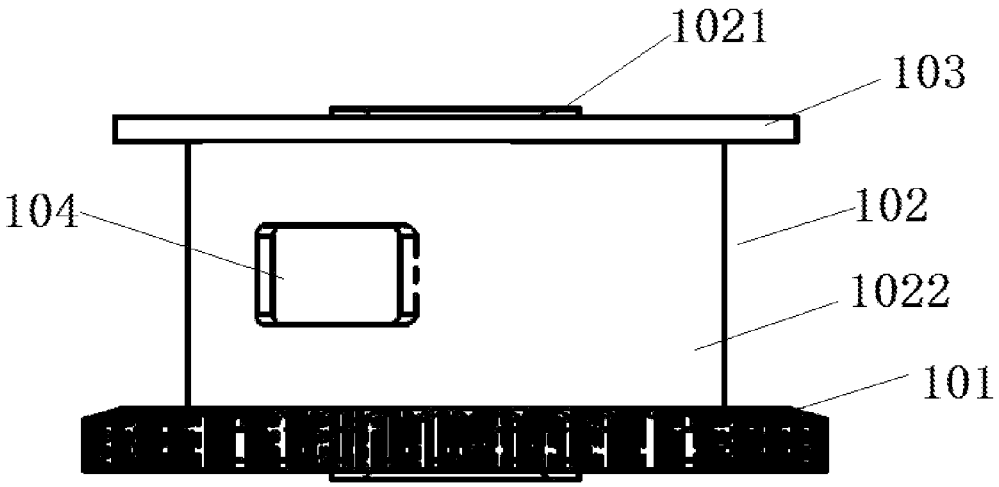
FIG. 3 is a front view of a driving wheel in one embodiment of the present invention.
Figure 4:
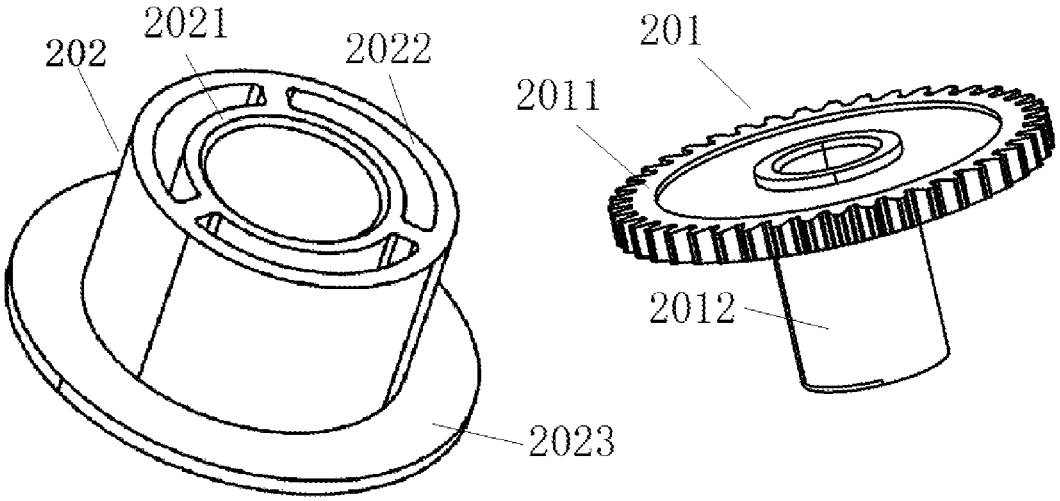
FIG. 4 is perspective views of a driven wheel gear assembly and a retainer ring assembly in one embodiment of the present invention.
Figure 5:
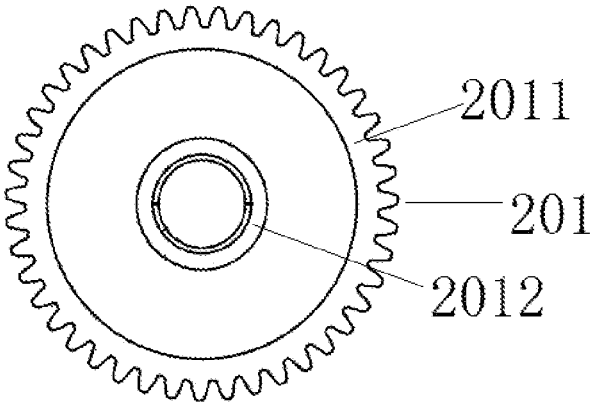
FIG. 5 is a bottom view of a driven wheel gear assembly in one embodiment of the present invention.
Figure 6:
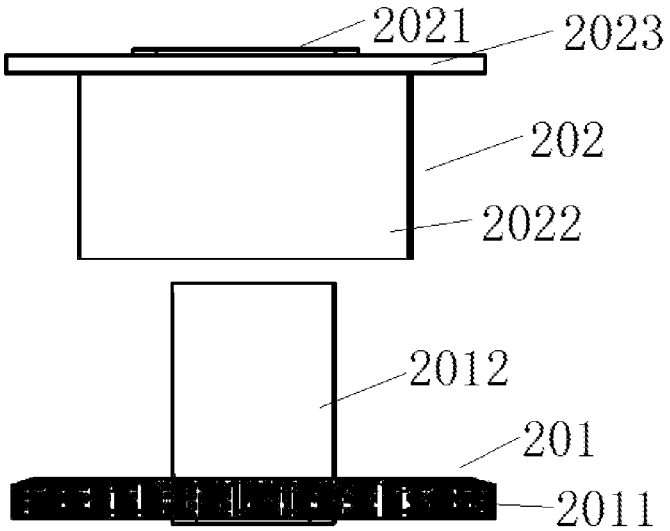
FIG. 6 is a front view of a driven wheel gear assembly and a retainer ring assembly in one embodiment of the present invention.
Figure 7:
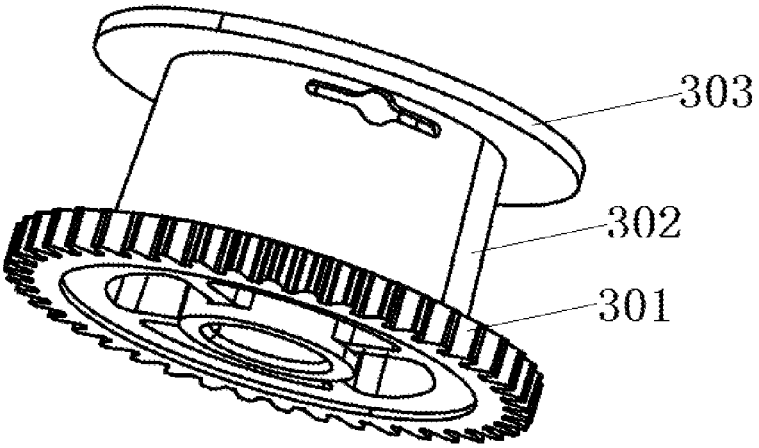
FIG. 7 is a perspective view of an active reel in one embodiment of the present invention.
Figure 8:
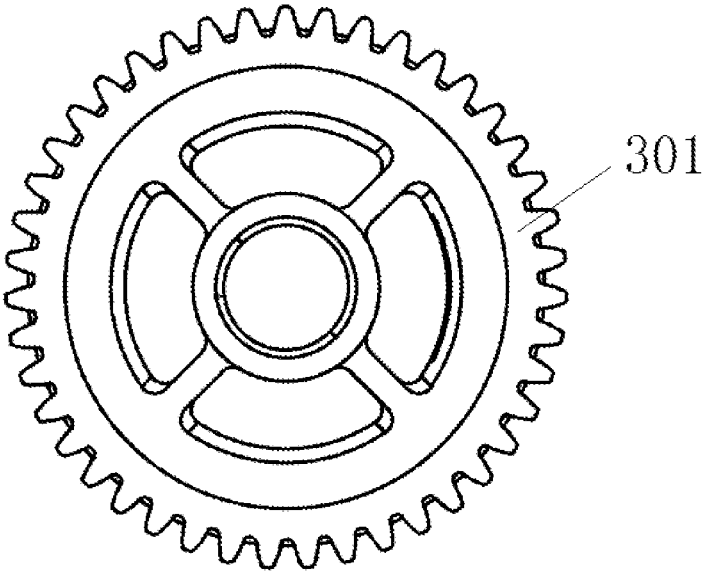
FIG. 8 is a bottom view of an active reel in one embodiment of the present invention.
Figure 9:
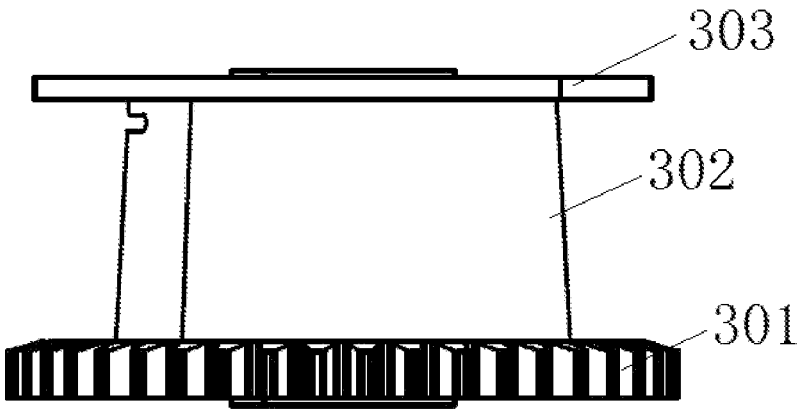
FIG. 9 is a cross-sectional view of an active reel in one embodiment of the present invention.
Figure 10:
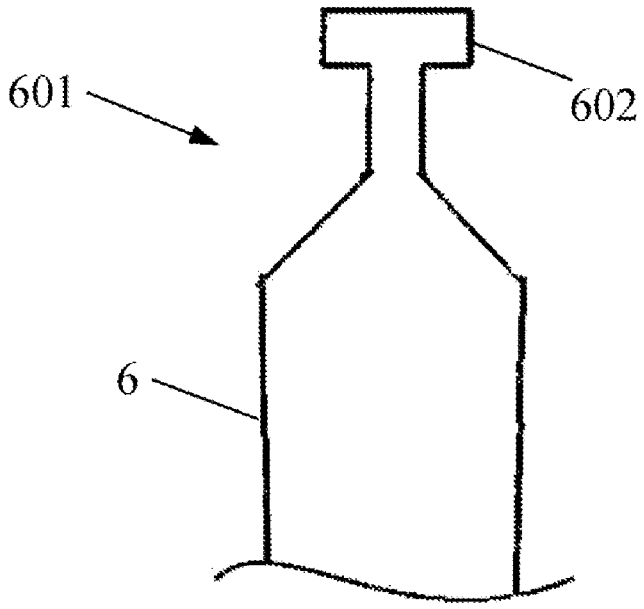
FIG. 10 is a view of a hook of a head of a scroll spring in one embodiment of the present invention.
Figure 11:
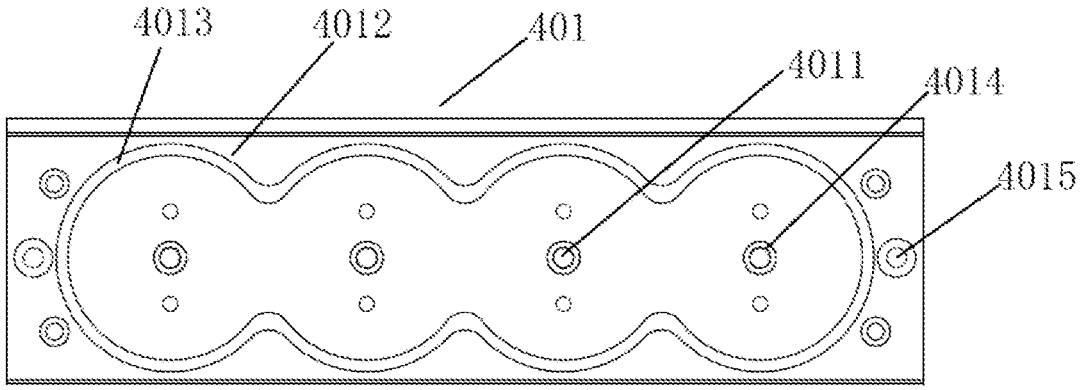
FIG. 11 is a top view of an upper plate of the mounting box in one embodiment of the present invention.
Figure 12:
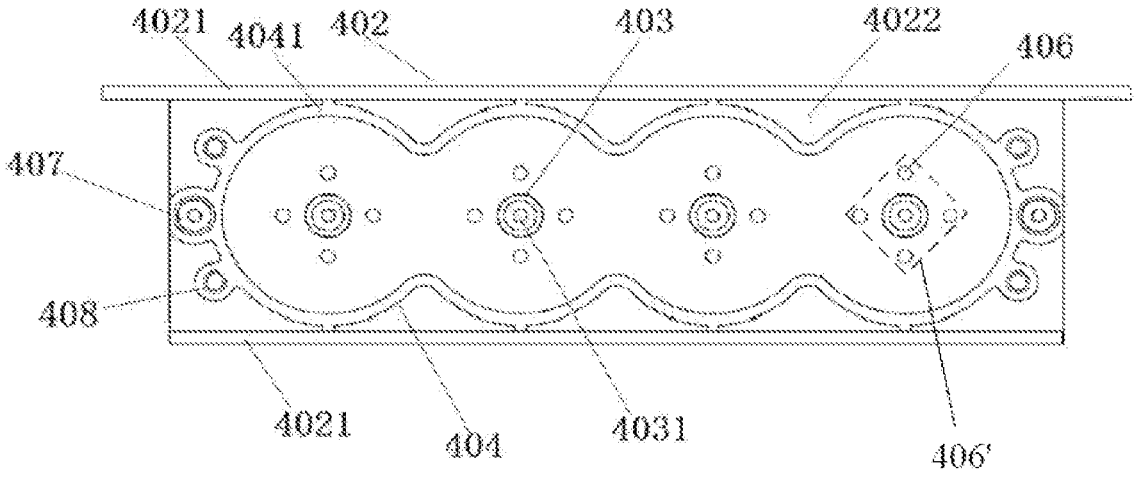
FIG. 12 is a top view of a lower plate of a mounting box in one embodiment of the present invention.
Figure 13:
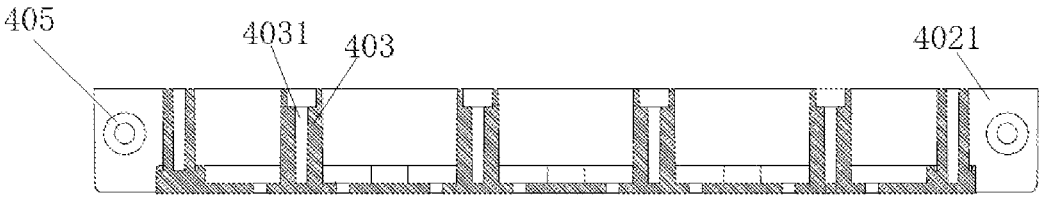
FIG. 13 is a cross-sectional view of a lower plate of a mounting box in one embodiment of the present invention.
Figure 14:
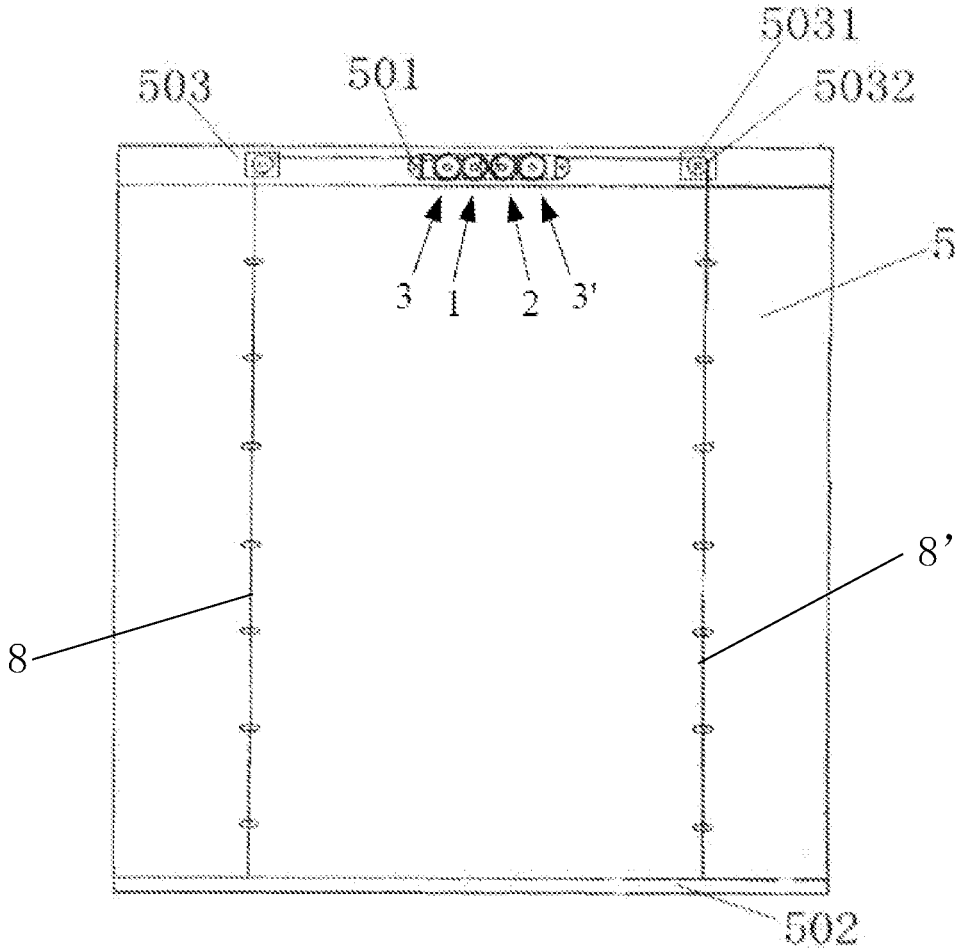
FIG. 14 is a view of a curtain body in one embodiment of the present invention. Description of reference signs.

Driving Wheel 1; Gear 101 of Driving Wheel; Winding Post 102 of Driving Wheel; Positioning Sleeve Barrel 1021; Winding Sleeve Barrel 1022; Connecting Rib Plate 1023; Retainer Ring 103 of Driving Wheel 103; Socket 104

Driven Wheel 2; Gear Assembly 201 of Driven Wheel; Gear 2011 of Driven Wheel; Positioning Sleeve 2012; Retainer Ring Assembly 202 of Driven Wheel; Inner Sleeve Barrel 2021; Outer Sleeve Barrel 2022; Retainer Ring 2023;

Active Reel 3; Gear 301 of Active Reel; Winding Post 302 of Active Reel; Retainer Ring 303 of Active Reel;

Mounting Box 4; Upper Plate 401 of Mounting Box; Upper Plate Screw Through Hole 4011; Upper Plate Limiting Groove 4012; Upper Plate Arc Portion 4013; Protrusion 4014; Circle Ring 4015; Lower Plate 402 of Mounting Box; Side Plate 4021 of Lower Plate of Mounting Box; Bottom Plate 4022 of Lower Plate of Mounting Box; Positioning Post 403; Screw Hole 4031 of Positioning Post; Lower Plate Limiting Groove 404; Lower Plate Arc Portion 4041; Lug 405; Positioning Hole 406; Center Wiring Post 407; Side Wiring Post 408;

Curtain Body 5; Fixing Plate 501; Weighting Block 502; Wiring Wheel 503; Bracket 5031; Pulley 5032.

DETAILED DESCRIPTION OF THE PREFERRED EMBODIMENT

A lifting push-pull positioning curtain comprised a curtain body, a mounting box and a push-pull positioning device.

Push-Pull Positioning Device

A push-pull positioning device was used to realize the retracting and positioning of a curtain body 5 so that the curtain body 5 could be positioned at any designated position. The push-pull positioning device provided the force to pull and position the bottom of the curtain body 5.

In some embodiments, the push-pull positioning device was located in the mounting box 4, the mounting box 4 comprised an upper mounting plate 401 and a lower mounting plate 402; the push-pull positioning device comprised an active reel 3, a transmission wheel set and a slave reel 3', the lower mounting plate 402 was provided with the positioning post 403, the active reel 3, the transmission wheel set and the slave reel 3' correspond to respective positioning posts 403 respectively.

The transmission wheel set comprised a driving wheel 1 and a driven wheel 2, a scroll spring 6 was received in the driven wheel 2 received a scroll spring 6 therein, the head end 601 of the scroll spring 6 was connected to the driving wheel 1; the active reel 3 and the slave reel 3' winded a thread rope 8, 8' respectively, and one end of the thread rope 8, 8' was fixed to the reel and the other end thereof was fixed to the bottom of the curtain body 5; when the active reel 3 was outwardly unwound, the driving wheel 1 winded the scroll spring 6 inwardly; the direction of the scroll spring 6 being wound into the driving wheel 1 was opposite to the direction of a scroll. The direction of the scroll referred to the direction in which the scroll spring 6 was wound by means of a conventional process. When the surface of the scroll spring 6 in contact with the driven wheel 2 was an inner surface, the surface of the scroll spring 6 in contact with the driving wheel 1 was an outer surface.

The length of the thread rope 8, 8' corresponding to the active reel 3 and the slave reel 3' was the same, the length of the thread rope 8, 8' received in the reels was also the same. Thereby, the bottom of the curtain body 5 was kept horizontal, and horizontally raised and lowered.

In some embodiments, the active reel 3, the slave reel 3', the driving wheel 1, and the driven wheel 2 had respective gears, winding posts, and retainer rings respectively, and the gear and the retainer ring were located at the two ends of the winding post respectively, the four gears were sequentially engaged, with a distance between the four retainer rings. Thus, for each wheel, the reel or the transmission wheel, only one end thereof was processed into the gear, which not only reduced the processing difficulty, but also indicated the installation direction of the wheel.

In some embodiments, the active reel 3, the driving wheel 1, the driven wheel 2 and the slave reel 3' were sequentially engaged, the scroll spring 6 in a natural state was located in the driven wheel 2, the direction of rewinding the scroll spring 6 by the driving reel was the same as the direction of rewinding the first thread rope 8 by the active reel 3; the direction of rewinding the first thread rope 8 by the active reel 3 was the same as the direction of rewinding the second thread rope 8' by the driven wheel 2. When the gears were meshed in transmission, the adjacent gears were rotated in opposite directions. When the active reel 3 was outwardly unwound, the scroll spring 6 was reversely wound by the driving wheel 1, the scroll spring 6 in the driving wheel 1 was in a deformed state, the gravity of the curtain body 5 was balanced with the elastic force of the scroll spring 6.

In some embodiments, the length of the scroll spring 6 was greater than the length of the thread rope 8, 8' wound into the reel. Thus, after the rope 8, 8' was completely released, the scroll spring 6 still had a residual length in the driven wheel 2. Therefore, there was no need to perform a fixing process between the trail end of the scroll spring 6 and the driven wheel 2, the scroll spring 6 can be held in the driven wheel 2 by means of the elastic force of the scroll spring 6 itself.

Driving Wheel and Driven Wheel

The drive wheel 1 and the driven wheel 2 were a pair of rollers of push-pull positioning devices that released or rewound the scroll spring 6, and the scroll spring 6 provided a force for positioning the curtain 5.

In some embodiments, the winding post 102 of the driving wheel 1 was thicker than the winding post of the driven wheel 2. The thicker the winding post 102 of the driving wheel 1, the larger the radius of curvature of the scroll spring 6 deformation. Therefore, when the scroll spring 6 was wound into the driving wheel 1, as the scroll spring 6 was wound into the driving wheel 1, the radius of curvature of the spring 6 in the driving wheel 1 was larger than the radius of curvature of the spring 6 in the driven wheel 2, that was, the more the scroll spring 6 was wound into the driving wheel 1, the weaker the tendency of the spring 6 to recover deformation, avoiding the problem that the curtain body 5 automatically raised due to the excessive spring 6 force of the tail of the spring 6.

In some embodiments, after the scroll spring 6 was mounted in position in the driven wheel 2, the diameter of the winding post of the driven wheel 2 superimposed with the scroll spring 6 was equal to the diameter of the winding post 102 of the driving wheel 1. The equality of the two diameters meant that the difference between the two diameters was within the allowable error range but was not absolutely equal in mathematical terms. In this way, when the scroll spring 6 was just wound into the driving wheel 1, the winding radius of curvature of the scroll spring 6 in the driving wheel 1 was substantially equal to the winding radius of curvature of the scroll spring 6 in the driven wheel 2, after all the thread ropes 8, 8' in the reel were unwound, the diameter of the spring 6 in the driving wheel 1 was maximized while the diameter of the spring 6 in the driven wheel 2 was minimized.

When the scroll spring 6 in the driven wheel 2 was reversely wound into the driving wheel 1 from the head end 601, the diameter of the winding post 102 of the driving wheel 1 and the diameter of the winding post of the driven wheel 2 were substantially equal, as the number of turns of the spring 6 wound in the driving wheel 1 increased, the diameter of the scroll spring 6 of the wheel was larger than the diameter of the scroll spring 6 of the driven wheel 2, the larger the deformation radius of curvature of the scroll spring 6 in the driving wheel 1, the smaller the torque provided by the scroll spring 6 in the driving wheel 1, that was, the outer ring of the scroll spring 6 of the drive wheel provided less torque than that the inner ring thereof provided. Correspondingly, the more the number of turns of the scroll spring 6 of the driving wheel 1, the more the wire was unwound outwardly, the lower the position where the curtain body 5 was lowered, the smaller the weight of the curtain body 5 supported by the thread rope 8, 8' (this was because as the bottom of the curtain body 5 was lowered, the curtain body 5 was unfolded, and more and more parts were supported by the curtain body 5 itself; when the curtain body 5 was wound up, the rolled curtain body 5 couldn't support itself, but depended on the thread rope 8, 8' to support, therefore, the more the curtain body 5 was unfolded, the smaller the force on the thread rope 8, 8', the more the curtain was wound up, the greater the force on the thread rope 8, 8'). The more the scroll spring 6 of the driven wheel 2 was wound into the driving wheel 1, the smaller the torque provided by the scroll spring 6, so that the curtain body 5 was unfolded and the force of the thread rope 8, 8' was reduced, thereby avoiding the phenomena that the curtain body 5 couldn't be self-locked in the unfolded state and automatically risen; at the same time, the curtain body 5 was provided with effective support when the curtain body 5 was wound up, so as to avoid the phenomenon that the curtain body 5 automatically dropped.

In some embodiments, the head end 601 of the scroll spring 6 was provided with a hook 602, the winding post 102 of the driving wheel 1 was provided with a socket 104, the hook 602 was hung in the socket 104. In some embodiments, the winding post 102 of the driving wheel 1 comprised a positioning sleeve barrel 1021 and a winding sleeve barrel 1022, the positioning sleeve barrel 1021 and the winding sleeve barrel 1022 were coaxial and spaced apart, and a radial connecting rib plate 1023 was arranged between the positioning sleeve barrel 1021 and the winding sleeve barrel 1022, the socket 104 penetrates the winding sleeve barrel 1022. The hook 602 was inserted into the socket 104, and hooked the winding sleeve barrel 1022 to realize the connection between the scroll spring 6 and the driving wheel 1.

Both ends of the socket 104 were slopes in the radial direction. The slope guided the scroll spring 6 so that the spring 6 was smoothly wound into the winding post 102. The diameter of the winding sleeve barrel 1022 was the diameter of the winding post 102 of the driving wheel 1. In some embodiments, the driven wheel 2 comprised a gear assembly 201 and a retainer ring assembly 202, the gear assembly 201 consisted of a gear 2011 and a positioning sleeve 2012, the gear 2011 was concentric and fixed with the positioning sleeve 2012; the retainer ring assembly 202 consisted of an inner sleeve barrel 2021, an outer sleeve barrel 2022, and a retainer ring 2023 that were coaxial, a space was provided between the inner sleeve barrel 2021 and the outer sleeve barrel 2022, a radial connecting plate was arranged between the inner sleeve barrel 2021 and the outer sleeve barrel 2022, the positioning sleeve 2012 was inserted into the inner sleeve barrel 2021 and was in clearance fit with the inner sleeve barrel 2021; the diameter of the outer sleeve barrel 2022 was taken as the diameter of the winding post of the driven wheel 2. The gear assembly 201 and the retainer ring assembly 202 were detachable, and a scroll spring 6 product could be conveniently sleeved on the outer sleeve 2022, and then the positioning sleeve 2012 was inserted into the inner sleeve barrel 2021, and the gear assembly 201 and the retainer ring assembly 202 were combined into the driven wheel 2 with the scroll spring 6 therein. The driven wheel 2 was detachable, which made it easy to use the finished scroll spring 6 to reduce costs.

The scroll spring 6 was wound into a cylinder by a spring 6 belt in an equal width by means of a conventional process, the head end 601 of the spring 6 belt was provided with a hook 602, the hook was T-shaped. The spring 6 belt had the same formation radius of curvature from the head end 601 to the trailing end. It was only necessary to purchase the existing scroll spring 6 for direct use, and it was no longer necessary to design and manufacture the scroll spring 6 for the present invention, which reduced the production cost of the present invention.

The Upper Mounting Plate and the Lower Mounting Plate

The upper mounting plate 401 and the lower mounting plate 402 were components of the mounting box 4, and after the upper mounting plate 401 and the lower mounting plate 402 were assembled, a space for receiving the two reels, the driving wheel 1 and the driven wheel 2 was formed.

In some embodiments, the upper mounting plate 401 and the lower mounting plate 402 form a mounting box 4 that received the active reel 3, the transmission wheel set, and the slave reel 3'; the mounting box 4 had a wire outlet port that allowed the thread rope 8, 8' out; the upper mounting plate 401 had a screw through hole 4011 corresponding to the positioning post 403 of the lower mounting plate 402 one by one, and the positioning post 403 was provided thereon with a screw hole 4031 aligned with the screw through hole 4011. After a screw was screwed into the screw hole by passing through the screw through hole 4011, the upper mounting plate 401 was fixed at the lower mounting plate 402. The upper mounting plate 401 and the lower mounting plate 402 limited the axial position of the two reels and the transmission wheel set so that the four gears remained engaged.

In some embodiments, the lower mounting plate 402 was provided with a lower plate limiting groove 404, and the lower plate limiting groove 404 had a lower plate arc portion 4041 corresponding to each gear one by one, each lower plate arc portion 4041 was in clearance fit with the corresponding gear. The lower plate limiting groove 404 matched the gear, and the size of lower plate limiting groove 404 was larger than that of the retainer ring. The lower plate limiting groove 404 had a function of indicating, which indicated that the gear should be provided with the lower mounting plate 402. In some embodiments, the lower plate limiting groove 404 was centered with the lower mounting plate 402, each lower plate arc portion 4041 of the lower plate limiting groove 404 was coaxial with the corresponding positioning post 403 thereof. After determining the gear diameter and the gap between the gear and the lower plate limiting groove 404, the position and size of the lower plate limiting groove 404 could be determined; and then the concentric positioning post 403 was provided at the center of each lower plate arc portion 4041 of the lower plate limiting groove 404 to determine the position of the positioning post 403. Each positioning post 403, the wheel and the corresponding lower plate arc portion 4041 were coaxial.

In some embodiments, the lower mounting plate 402 comprised a bottom plate 4022 and two opposite side plates 4021, the lower plate limiting grooves 404 were provided on the bottom plate 4022, and the upper mounting plate 401 was opposite to the bottom plate 4022. The upper mounting plate 401 and the lower mounting plate 402 formed a rectangular box body, and there were no closed openings at both ends as the wire outlet ports.

In some embodiments, the lower mounting plate 402 was provided with two lugs 405, the lugs 405 were located at the end of the wire outlet port, and the lugs 405 were provided thereon with the screw hole. The screw passed through the screw hole on the lug 405 to fix the push-pull positioning device on the curtain body 5.

In some embodiments, one positioning hole group 406' was provided around each positioning post 403, the positioning hole group 406' was provided on the bottom plate 4022, and each positioning hole group 406' formed an equilateral polygon, the positioning post 403 and the equilateral polygon formed by the positioning hole group were concentric, the positioning post 403 and the lower mounting plate 402 were integrally injection-molded, each positioning hole group could be used as a release hole while injection molding, so that each positioning post 403 could be demolded in translation, and the verticality of the positioning post 403 and the bottom plate 4022 can be ensured.

In some embodiments, each positioning hole set 406' had four positioning holes 406, wherein a pair of diagonal positioning holes 406 were collinear with all of the positioning posts 403. The four positioning holes 406 made the circumference of the positioning post 403 evenly stressed, which was beneficial to ensure the verticality. The more the positioning post 403 was perpendicular to the bottom plate, the smaller the impact between a wiring wheel and the positioning post 403, as well as the impact between the driving wheel 1 and the positioning post 403 and the impact between the driven wheel 2 and the positioning post 403.

In some embodiments, the upper mounting plate 401 was provided thereon with an upper plate limiting groove 4012, and the upper plate limiting groove 4012 had an upper plate arc portion 4013 corresponding to each of the retainer rings one by one, each upper plate arc portion 4013 was in clearance fit with the corresponding gear; the upper plate limiting groove 4013 was aligned with the upper plate 401, each upper plate arc portion 4013 was coaxial with the corresponding screw through hole 4011. After determining the diameter of the retainer ring and the gap between the retainer ring and the upper plate limiting groove 4012, the position and size of the upper plate limiting groove 4012 could be determined; and then the concentric screw through hole 4011 was provided at the center of a circle of each upper plate arc portion 4013 of the upper plate 401 in the upper plate limiting groove 4012 to determine the position of the screw through hole 4011. Each screw through hole 4011, the wheel and the corresponding upper plate arc portion 4013 were coaxial. After the screw through hole 4011 matched the corresponding positioning post 403, the centering of the upper mounting plate 401 and the lower mounting plate 402 was achieved.

In some embodiments, the upper mounting plate 401 was provided with a cylindrical protrusion, each screw through hole 4011 corresponds to one protrusion 4014, the screw through holes 4011 were coaxial with the respective protrusion 4014; each protrusion 4014 was inserted into the corresponding positioning sleeve barrel 1021 or the positioning sleeve barrel, the protrusion 4014 was in contact with or had a gap with the corresponding positioning post 403; or the positioning post 403 was provided thereon with a groove for allowing the protrusion 4014 to be inserted, and the height of the groove was adapted to the protrusion 4014. The protrusion 4014 and the positioning post 403 simultaneously positioned the axial position of the winding post while locking the relative position between the upper mounting plate 401 and the lower mounting plate 402; in addition, the protrusion 4014 protected the screw, the active reel 3, the slave reel 3', the driving wheel 1 and the driven wheel 2 were not directly in contact with the screw, and the vibration produced when the active reel 3, the slave reel 3', the driving wheel 1 and the driven wheel 2 are rotated was isolated.

Wiring Post

The wiring post was a structure that was placed on the lower plate for tensioning and positioning the thread rope.

In some embodiments, the lower mounting plate 402 was provided with a pair of center wiring posts 407 and at least one pair of side wiring posts 408; the two center wiring posts 407 were collinear with the positioning post 403, and the two side wiring posts 408 deviated from the straight line where the positioning post 403 was located; the two center wiring posts 407 was symmetrically provided, the two side wiring posts 408 were symmetrically arranged; the thread rope 8, 8' was taken out from the outlet port by sequentially bypassing the side wiring post 408 and the center wiring post 407. The side wiring post 408 tensioned the thread rope 8, 8', the center wiring post 407 made the drawn thread rope 8, 8' collinear with the center of the two reels, which was favorable for the thread rope 8, 8' to smoothly output the wire.

In some embodiments, two pairs of the side wiring posts 408 were provided, the two opposite side wiring posts 408 were symmetric with respect to the straight line where the positioning post 403 was located; the thread rope 8, 8' was taken out from the wire output port by sequentially bypassing the two side wiring posts 408 and the center wiring post 407; or the thread rope 8, 8' was take out from the wire output port by bypassing any side wiring post 408 and the center wiring post 407; or the thread rope 8, 8' was then taken out from the outlet port after bypassing the two side wiring post 408, the center wiring post 407 tightly abutted the thread rope 8, 8' between the two side wiring posts 408. The two wiring posts 408 facilitated the tensioning of the thread rope 8, 8' and eliminated the change in the direction of the thread rope 8, 8' due to the change in the diameter of the thread rope 8, 8' during the winding and unwinding of the reel.

In some embodiments, the center wiring post 407 was provided thereon with the screw hole, the upper mounting plate 401 had a screw through hole that was aligned with the center wiring post 407, the screw was screwed into the screw hole of the center wiring post 407 through the screw through hole. Therefore, the two sides of the upper mounting plate 401 and the lower mounting plate 402 were relatively fixed to avoid deformation and displacement of the center wiring post 407 under the pressure of the thread rope 8, 8', and the consistency of the unwinding of the two wire reels was maintained, so that the bottom of the curtain was always kept horizontal. The center wiring post 407 was located outside the lower plate limiting groove 404, and a gap provided between the center wiring post 407 and the lower plate limiting groove 404.

In some embodiments, the upper mounting plate 401 had the circle ring 4015 that matched the center wiring post 407, the center wiring post 407 was inserted into the circle ring 4015, the screw through hole was coaxial with the circle ring 4015. The circle ring 4015 locked the position of the center wiring post 407 to prevent vibration from directly impacting the screw.

Active Reel and Slave Reel

The active reel 3 and the slave reel 3' were the reels that winded up and released the thread rope 8, 8' that pulled the bottom of the curtain body 5. The active reel 3 and the slave reel 3' were relative, since the active reel 3, the driving wheel 1, the driven wheel 2 and the slave reel 3' were meshed and transmitted by the gear, when any one of the reels received an external force, the other winding reel would follow the rotation. Therefore, the active reel 3 referred to a wheel that was subjected to an external force, relatively speaking, the other reel was the slave reel 3'. That was to say, the active reel 3 and the slave reel 3' were based on the actual force and were used to distinguish the two wheels, which was not irreplaceable.

In some embodiments, the winding post 302 of the active reel 3 and the winding post of the slave reel 3' were both conical, and one end of the winding post connected to the gear was a big end and the other end was a small end. When the curtain was moved up and the rope 8, 8' was recovered into the reel, the ropes 8, 8' of the two reels were displaced from the big end to the small end, so that the active reel 3 and the slave reel 3' were wound synchronously in the same length, and the bottom of the curtain was always kept horizontal.

Wiring Wheel

The wiring wheel 503 was mounted outside the push-pull positioning device. The thread rope 8, 8' drawn from both ends of the push-pull positioning device passed through the corresponding wiring wheel 503 respectively and then was connected to the bottom of the curtain body 5.

In some embodiments, the top of the curtain body 5 was provided with a fixing plate 501, and the bottom of the curtain body 5 was provided with a weighting block 502; the push-pull positioning device was mounted on the fixing plate 501, the fixing plate 501 was provided with a pair of the wiring wheels 503, the wiring wheels were symmetrically provided on both sides of the push-pull positioning device; the wiring wheel 503 comprised a bracket 5031 and a pulley 5032, the thread rope 8, 8' bypassed the pulley 5032, the bracket 5031 had a shaft thereon, the pulley 5032 was rotatably connected with the shaft, the bracket 5031 was hinged with the fixing plate 501. The wiring wheel 503 could swing with the thread rope 8, 8' to realize the wiring at any angle, so that the winding and unwinding of the active reel 3 and the slave reel 3' were not affected by the angle.

The weighting block 502 was wrapped in the curtain body 5, and the curtain body 5 was provided with a wiring passage, and the thread rope 8, 8' was fixed with the weighting block 502 via the wiring passage. The wiring passage consisted of a wiring barrel and a plurality of wiring loops, and the wiring loops are wrapped in the wiring barrel. The presence of the wiring passage defined the oscillating area of the thread rope 8, 8' and wraps the thread rope 8, 8' for aesthetics and protection.

The present invention shown and described herein can be implemented in the absence of any of the elements and limitations specifically disclosed herein. The terms and expressions used are used as the terms of description and are not limitation, and it is not intended to exclude any equivalents of the features and portions thereof shown and described in the use of these terms and expressions, and it should be known that variations are possible within the scope of the invention. It is understood that although the present invention has been specifically disclosed by the various embodiments and the optional features, the modifications and variations of the concepts described herein may be employed by those skilled in the art, and are within the scope of the invention defined by the attached claims.

The contents of articles, patents, patent applications, and all other documents and electronically available information described or recited herein are hereby incorporated by reference in their entirety, as if each separate publication is specifically and separately pointed out for reference. The Applicant reserves the right to incorporate any and all materials and information from any such article, patent, patent application or other document into the present application.

What is claimed:

1. A lifting push-pull positioning curtain, comprising a curtain body having a bottom, a mounting box and a push-pull positioning device; wherein:

the push-pull positioning device is located in the mounting box, the mounting box comprises an upper mounting plate and a lower mounting plate, the lower mounting plate is provided with a plurality of positioning posts;

the push-pull positioning device comprises an active reel, a transmission wheel set and a slave reel, the active reel corresponds to one of the positioning posts, the transmission wheel set corresponds to two of the positioning posts, and the slave reel corresponds to one of the positioning posts;

the transmission wheel set comprises a driving wheel and a driven wheel, the driven wheel receives a scroll spring therein, a head end of the scroll spring is connected to the driving wheel;

a first thread rope is wound around the active reel, and a second thread rope is wound around the slave reel, one end of the first thread rope is fixed to the active reel and another end of the first thread rope is fixed to the bottom of the curtain, and one end of the second thread rope is fixed to the slave reel and another end of the second thread rope is fixed to the bottom of the curtain;

the active reel, the driving wheel, the driven wheel, and the slave reel are configured sequentially in the push-pull positioning device such that when the active reel is outwardly rotated, the driving wheel winds the scroll spring inwardly; the scroll spring of the driven wheel is configured to be reversely wound into the driving wheel;

the upper mounting plate and the lower mounting plate form the mounting box for receiving the active reel, the transmission wheel set and the slave reel, the mounting box has a first wire outlet port allowing the first thread rope out and a second wire outlet port allowing the second thread rope out, the lower mounting plate is provided with a pair of center wiring posts and two pairs of side wiring posts, and the two pairs of side wiring posts are symmetric with respect to a straight line where the positioning posts are located; the pair of center wiring posts includes a first center wiring post and a second center wiring post, two pairs of side wiring posts includes a first pair of side wiring posts and a second pair of side wiring posts, the first thread rope is configured to exit through the first wire outlet port after sequentially passing around the first pair of side wiring posts and the first center wiring post, the second thread rope is configured to exit through the second wire outlet port after sequentially passing around the second pair of side wiring posts and the second center wiring post, the first center wiring post abuts the first thread rope between the first pair of side wiring posts, the second center wiring post abuts the second thread rope between the second pair of side wiring posts;

a positioning hole group is arranged around each of the positioning posts, the positioning hole group is provided on a bottom plate of the mounting box, the positioning hole group comprises four positioning holes that form an equilateral polygon, a pair of diagonal positioning holes of the positioning hole group are collinear with all the positioning posts, and the positioning posts and the equilateral polygon formed by the positioning hole group are concentric;

two lugs extending from the lower mounting plate, and the two lugs are located at the end of the first wire outlet port and the second wire outlet port, respectively: and wherein the center wiring posts have screw holes, the upper mounting plate has screw through holes aligned with the center wiring posts, and screws are screwed into the screw holes of the center wiring posts through the screw through holes.

2. The lifting push-pull positioning curtain according to claim 1, wherein each of the active reel, the slave reel, the driving wheel and the driven wheel has a gear, a winding post and a retainer ring, for each of the active reel, the driving wheel, the driven wheel, and the slave reel, the gear and the retainer ring are located at opposite ends of the winding post, gears of the active reel, the driving wheel, the driven wheel, and the slave reel are sequentially engaged, and a distance is provided between each of the retainer rings of the active reel, the driving wheel, the driven wheel, and the slave reel.

3. The lifting push-pull positioning curtain according to claim 2, wherein the active reel, the driving wheel, the driven wheel and the slave reel are sequentially engaged, the scroll spring in a natural state is located in the driven wheel, a direction of rolling the scroll spring by the driving wheel is the same as a direction of rolling the first thread rope by the active reel; a direction of rolling the first thread rope by the active reel is the same as a direction of rolling the second thread rope by the driven reel.

4. The lifting push-pull positioning curtain according to claim 1, wherein the lower mounting plate is provided with a lower plate limiting groove, and the lower plate limiting groove has a lower plate arc portion.

5. The lifting push-pull positioning curtain according to claim 1, wherein the lower mounting plate comprises the bottom plate and two opposite side plates, a lower plate limiting groove is provided at the bottom plate, and the upper mounting plate is opposite to the bottom plate.

6. The lifting push-pull positioning curtain according to claim 1, wherein the upper mounting plate is provided with an upper plate limiting groove, and the upper plate limiting groove has an upper plate arc portion; the upper plate limiting groove is centered with the upper plate, and the upper plate arc portion is coaxial with a screw through hole.

7. The lifting push-pull positioning curtain according to claim 1, wherein the upper mounting plate is provided with a plurality of cylindrical protrusions.

8. The lifting push-pull positioning curtain according to claim 1, wherein the pair of center wiring posts are collinear with the plurality of positioning posts, and the two pairs of the side wiring posts deviate from a straight line where the plurality of positioning posts is located; the pair of center wiring posts are symmetrically arranged, and the two pairs of side wiring posts are symmetrically arranged.

9. The lifting push-pull positioning curtain according to claim 1, wherein a diameter of a winding post of the driving wheel is greater than or equal to a diameter of a winding post of the driven wheel.

10. The lifting push-pull positioning curtain according to claim 1, wherein the head end of the scroll spring is provided with a hook, and a winding post of the driving wheel is provided with a socket, and the hook is hung in the socket.

11. The lifting push-pull positioning curtain according to claim 1, wherein the scroll spring is wound around a winding post of the driving wheel or a winding post of the driven wheel, the winding post of the driving wheel comprises a positioning sleeve barrel and a winding sleeve barrel, the positioning sleeve barrel and the winding sleeve barrel are coaxial and spaced apart, and a radial connecting rib plate is arranged between the positioning sleeve barrel and the winding sleeve barrel, and a socket penetrates the winding sleeve barrel.

12. The lifting push-pull positioning curtain according to claim 1, wherein the driven wheel comprises a gear assembly and a retainer ring assembly, the gear assembly consists of a gear and a positioning sleeve, and the gear and the positioning sleeve are concentric and fixed; the retainer ring assembly consists of an inner sleeve barrel, an outer sleeve barrel and the retainer ring which are coaxial, a space is provided between the inner sleeve barrel and the outer sleeve barrel, and a radial connecting plate is arranged between the inner sleeve barrel and the outer sleeve barrel, and the positioning sleeve is inserted into the inner sleeve barrel and is in clearance fit with the inner sleeve barrel; a diameter of the outer sleeve barrel is taken as a diameter of a winding post of the driven wheel.

* * * * *